United States Patent [19]

Johns

[11] 4,180,820

[45] Dec. 25, 1979

[54] CIRCULARLY POLARIZED ANTENNA SYSTEM USING A COMBINATION OF HORIZONTAL AND BENT VERTICAL DIPOLE RADIATORS

[75] Inventor: McKinley R. Johns, Cherry Hill, N.J.

[73] Assignee: RCA Corporation, New York, N.Y.

[21] Appl. No.: 837,157

[22] Filed: Sep. 28, 1977

[51] Int. Cl.[2] ..... H01Q 21/26

[52] U.S. Cl. ..... 343/798; 343/797; 343/890

[58] Field of Search ..... 343/797, 798, 799, 727, 343/800, 890

[56] References Cited

U.S. PATENT DOCUMENTS

| | | | |
|---|---|---|---|
| 2,480,154 | 8/1949 | Masters | 343/798 |
| 3,943,522 | 3/1976 | Ben-Dov | 343/798 |

*Primary Examiner*—David K. Moore

*Attorney, Agent, or Firm*—Eugene M. Whitacre; Paul J. Rasmussen; Robert L. Troike

[57] ABSTRACT

A circularly polarized antenna system adapted to provide a desired radiation pattern about a support mast using four horizontal radiating elements spaced at 90° intervals about the support mast and by four vertically polarized dipoles with each vertical dipole mounted vertically spaced from the four horizontally polarized radiating elements. The four vertically polarized dipoles are spaced at 90° intervals about the mast. Both the horizontal radiators and the vertical dipoles are fed in rotating phase. Each of the four vertically polarized dipoles comprises a pair of dipole arms which arms are bent to form a V with the vertex pointing toward the mast to increase the radiation in the plane orthogonal to the lengthwise axis of the mast and to decrease the radiation in the direction of the axis of the mast.

6 Claims, 7 Drawing Figures

CIRCULARLY POLARIZED ANTENNA SYSTEM USING A COMBINATION OF HORIZONTAL AND BENT VERTICAL DIPOLE RADIATORS

BACKGROUND OF THE INVENTION

This invention relates to circularly polarized antennas, and more particularly, to circularly polarized antennas for use in FM radio or in television broadcasting where the antennas are mounted to the sides of a support mast capable of supporting other antenna systems for other stations and channels. This invention, more particularly, relates to an antenna which when mounted on this mast radiates an omnidirectional pattern about the mast. The problem becomes increasingly difficult when the desired pattern about the tower is in the circularly polarized mode. In the circularly polarized mode, the pattern in both the horizontally and vertically polarized fields should approximate each other with the appropriate phase difference to achieve the desired circular polarization.

Although horizontally polarized television broadcasting has been almost exclusively used in the United States of America, it appears from recent test results that circularly broadcasting might greatly improve television reception in large metropolitan areas. For this reason, the F.C.C. (Federal Communications Commission) has recently approved the use of circular polarization in television broadcasting.

A circularly polarized antenna system using a combination of turnstile and vertical dipole radiators was patented by Ben-Dov (U.S. Pat. No. 3,943,522, issued Mar. 9, 1976). Although this antenna system provides circular polarization when several such antenna systems are stacked one above the other to achieve more gain in the broadside direction, it was found that the vertical dipole radiators alone when mounted on a single pole without the horizontal supports (for example supports 58 and 59 in FIG. 6) produced a substantial amount of radiation parallel to the axis of the pole. It is also desirable that the antenna be more compact and that the elements be able to be spaced closer to each other without destroying the proper phase relationships required between the vertical dipoles and the horizontal radiators.

SUMMARY OF THE INVENTION

A circularly polarized antenna system is provided about a vertically oriented support mast by a radiating system including four horizontal radiating elements spaced about the tower and a system of four vertically oriented dipoles spaced vertically from the radiating elements. The four horizontal radiating elements extend horizontally at 90° intervals about the mast. These four horizontal radiating elements are fed in the relative phase rotation of 0°, 90°, 180° and 270°. The four vertically oriented dipoles are fed in the relative phase rotation of 0°, 190°, 180° and 270°. The four vertically oriented dipoles are spaced about the mast from each other and fed in amplitude and phase relationship relative to the radiating element to cause the horizontal pattern of the vertically polarized field associated with the vertical dipoles to be of similar shape and magnitude and in phase quadrature to the horizontally polarized field associated with the four horizontal radiating elements. Each of the four equal length vertically oriented dipoles are of an electrical length substantially greater than electrically one-half wavelength and being configured to present an aperture of one-half wavelength dipole. The vertically oriented dipoles each comprise a pair of vertically extending dipole arms with a bend near the center thereof.

DESCRIPTION OF THE INVENTION

Figure 1:
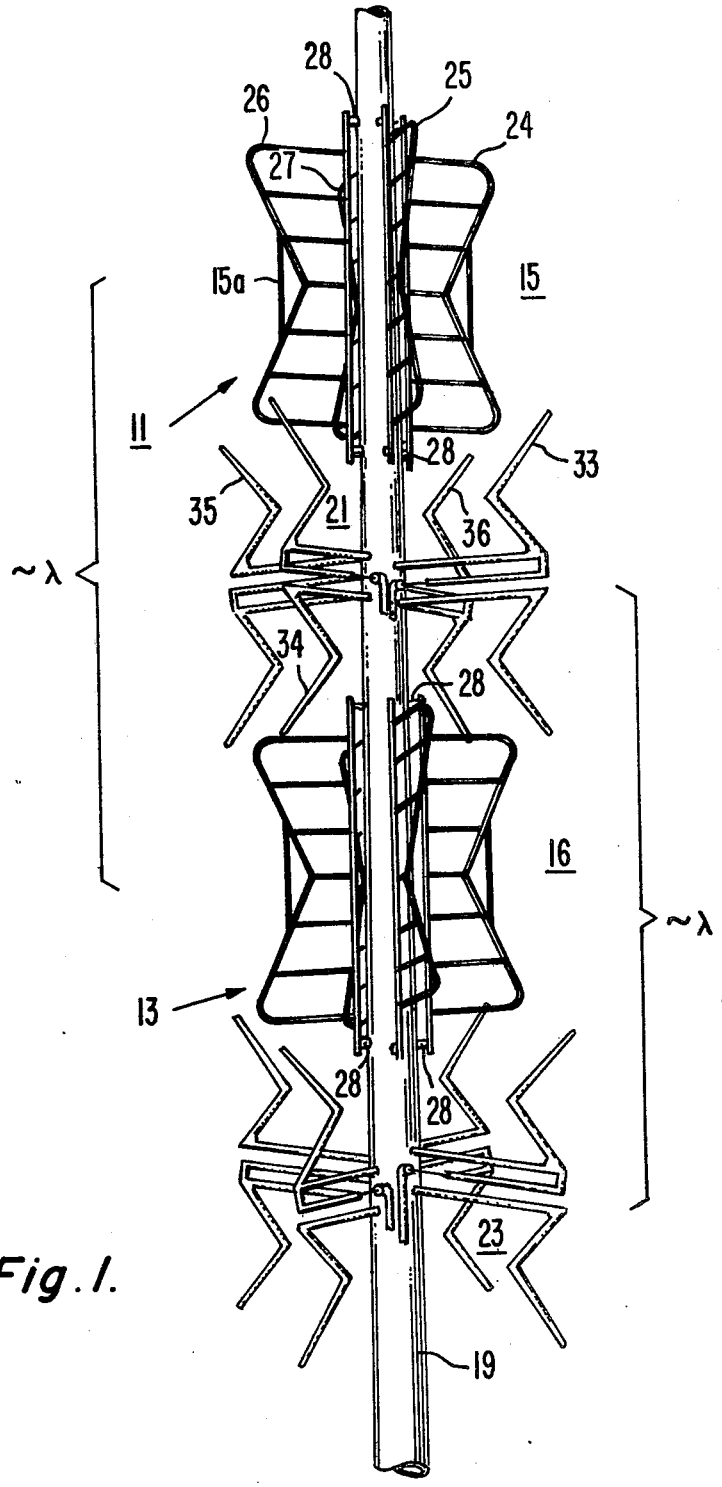
FIG. 1 is a perspective view of an antenna system according to an embodiment of the present invention.

Referring to FIG. 1, there is illustrated two stacked circularly polarized antenna systems 11 and 13 with antenna system 11 comprising a superturnstile antenna subsystem 15 for exciting horizontally polarized radiation about a support mast 19 and a subsystem 21 of four vertically oriented dipoles for exciting vertically polarized radiation. The antenna system 13 includes superturnstile subsystem 16 and the vertical dipole subsystem 23. The turnstile subsystems 15 and 16 are spaced between the vertical dipole subsystems 21 and 23 with the vertical dipole subsystem in each circularly polarized system being in the example below the associated turnstile antenna system. The mast 19 in this embodiment is a round metal pole.

Figure 2:
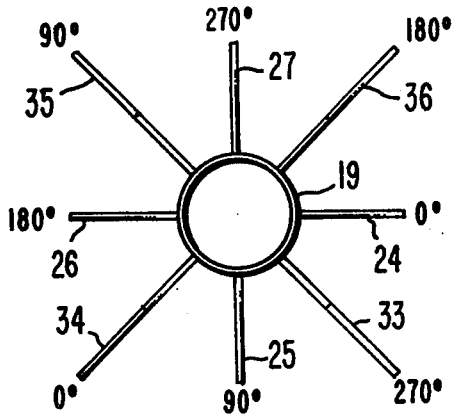
FIG. 2 is a sketch illustrating how the four horizontal radiating elements and the vertical dipoles of a circularly polarized system are fed.

The turnstile antenna subsystems 15 and 16 are identical and their radiation centers are spaced about a wavelength apart at an operating frequency of the antenna system apart. The term wavelength as used herein refers to a free space wavelength at an operating frequency of the antenna system. The turnstile antenna systems 15 and 16 are basically like that described as the "superturnstile" by Kraus in "Antennas" on pages 424 thru 428, a McGraw-Hill publication. Also, these "current sheet" radiators are described in U.S. Pat. Nos. 2,480,153 and 2,480,154 of R. W. Masters. The turnstile antenna system 15 comprises four such "current sheet" radiators 24, 25, 26 and 27 extending at 90° intervals from the mast with each of the sheets electrically connected at the upper and lower ends to the mast by members 28. The vertical height of the radiators 24 through 27 are made a little shorter than described in the patents and about a half wavelength. The vertical rod **15*a* shown in FIG. 1 improves the impedance match. The opposite "conductive sheets" extend in opposite directions and are fed along their vertical centers 180° out of phase. The conductive sheets 24, 25, 26 and 27 are fed in the relative phase rotation of 0°, 90°, 180° and 270° as shown in FIG. 2. The turnstile elements may also be like the fan elements in the above cited patent of Ben-Dov (U.S. Pat. No. 3,943,522) or the U.S. Pat. of O. M. Woodward No. 3,932,874. These turnstile elements like the fan elements in the above cited patents operate to excite the horizontally polarized waves about the support tower. With equal power to the sheet radiators 24**, 25, 26 and 27 and the relative phase rotation, a horizontally polarized omnidirectional pattern is achieved. When these types of radiators are stacked one above the other with about a wavelength between their centers, more gain is achieved in the horizontal or the direction broadside the support mast.

Figure 3:
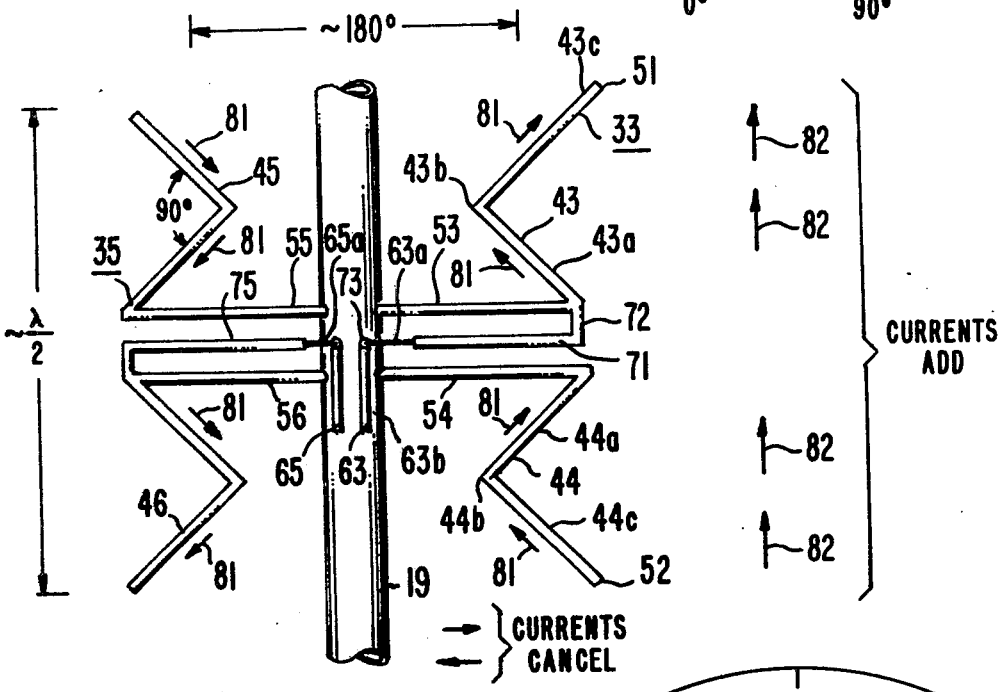
FIG. 3 illustrates a pair of the vertical dipoles.

Referring to FIGS. 1 and 3, there is illustrated the antenna systems 21 and 23 for exciting vertically polarized radiation. The antenna systems 21 and 23 are identical. The antenna system 21 includes four vertically oriented dipoles 33, 34, 35 and 36. The dipoles 33, 34, 35 and 36 extend at 90° intervals from the mast or tower 19. The plane of the dipoles 33, 34, 35 and 36 are rotated about 45° from the plane of the horizontal dipoles 24, 25, 26 and 27 as illustrated in FIG. 2. This rotates the vertically polarized radiation pattern in the horizontal plane about 45° to more closely match the horizontally polarized radiation pattern in horizontal plane. This also allows the antenna systems to be stacked closer to each other since the ends of dipoles 33 through 36 will not contact or be very close to the horizontal dipoles 24 thru 27. The dipoles 33 through 36 are fed in the relative phase rotation of 0°, 90°, 180° and 270° as illustrated in FIG. 2.

Referring to FIG. 3, there is illustrated by way of example dipoles 33 and 35. The dipole 33 comprises a pair of identical dipole arms with dipole arm 43 extending vertically upward and dipole arm 44 extending downward in the same plane and parallel to the mast. The dipole arms 43 and 44 are supported approximately one-quarter wavelength in the horizontal plane from the mast 19 by conductive supports 53 and 54. These supports are slightly greater than one-quarter wavelength long. Similarly, dipole 35 includes identical dipole arms 45 and 46 with horizontal supports 55 and 56. The dipole arm 43 extends upward and toward mast 19 over a first approximately half portion 43*a*. At about the midpoint 43*b*, the arm 43 makes about a 90° bend and then extends over portion 43*c* away from the mast 19 to form a generally V-shaped arm with the vertex or point 43*b* of the V-shape pointing toward the mast 19. The dipole arm 44 extends downward and toward the mast over a first approximately half portion 44*a*. At about the midpoint 44*b* the arm 44 makes about a 90° bend and then extends over portion 44*c* away from the mast 19 to form a generally V-shaped arm with the vertex of the V-shape pointing toward the mast 19. The length of each dipole arm is greater than a quarter wavelength. The total length along the arms from the tip 51 of arm 43 to the tip 52 of arm 44 is about three-quarter wavelength. The dipole arms 45 and 46 are similarly constructed and are generally coplanar with arms 43 and 44. The dipole arms 45 and 46 are of the same dimensions and have their approximate midpoints of the V or the vertex pointing toward the mast 19. The radiation centers are closer to the mast than the feed point at the ends of supports. The radiation centers of the opposite dipoles 33 and 35 are approximately 180° apart. The radiation centers in the embodiment shown are slightly over 180° owing to the diameter of the mast. The dipole arms 43 and 44 are fed 180° out of phase via the balun feed. The feed line 63 has an inner conductor 63*a* and outer conductor 63*b* which terminates at point 73. The outer conductor 63*b* is electrically connected to the mast 19 as is the metal supports 53 and 54. The inner conductor 63*a* of coax line 63 is connected to conductive member 71 which extends between supports 53 and 54 forming a balun therewith. The conductive member 71 is coupled via strap 72 to the upper arm 43 of the dipole 33. Similarly, dipole arms 45 and 46 are fed from coax transmission line 65 with a conductive member 75 extending between supports 55 and 56 connected to inner conductor 65*a* of the coax transmission line 65. The outer conductor 65*b* of the coax feed line is electrically connected to mast 19. The dipole 35 is fed 180° out of phase by connecting the remote end of member 75 to the lower dipole arm 46. The dipole arms 34 and 36 are similarly constructed with the dipole arm 34 fed like dipole arm 33 and dipole arm 36 fed like dipole arm 35. The feed lines for the dipoles 33 and 35 are electrically 90° longer.

Referring to the arrows 81 in FIG. 3 there is illustrated the currents along the dipoles. By the dipole arms reversing direction as shown, the currents as viewed above and below the dipoles reverse direction. The radiation above and below the dipoles is therefore reduced. This is especially desirable since such radiation is intercepted with the horizontal turnstile elements. These currents add in the desired horizontal direction as illustrated by arrows 82. It was found that by the arrangement shown herein the gain was increased in the horizontal direction while the amount of unwanted radiation above and below the dipole was greatly reduced.

Figure 4:
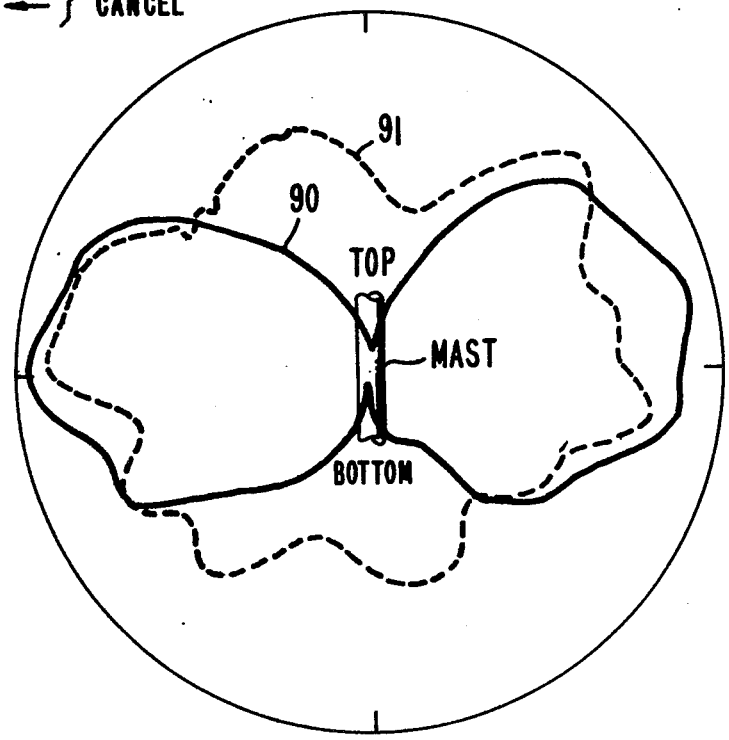
FIG. 4 illustrates the vertical patterns associated with the antenna system of FIG. 3 with and without the dipoles bent according to the present invention.
Figure 5:
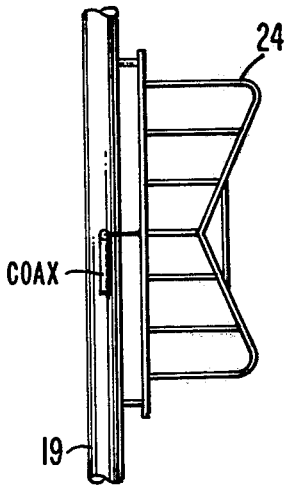
FIG. 5 illustrates how two of the four horizontal radiating elements may be fed.
Figure 6:
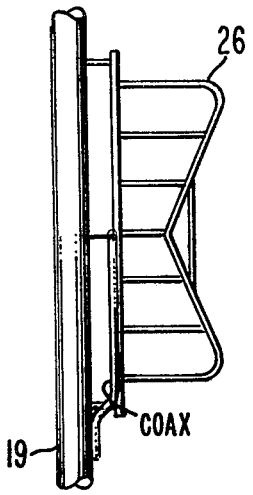
FIG. 6 illustrates how the other two of the four horizontal radiating elements may be fed.

FIG. 4 illustrates the vertical patterns associated with the antenna system of FIG. 1. Plot 90 of FIG. 4 illustrates the vertical pattern with two of the vertical dipole elements arranged as shown in FIG. 3 with the 90° V-shaped bends in each dipole arm. Plot 91 (in dashed lines) of FIG. 4 illustrates the vertical pattern associated with the vertical dipoles as shown in FIG. 3 without the 90° bend in the midpoint of the dipole arms. Since the vertical dipoles 33 thru 36 are substantially greater than one-half wavelength dipoles and approach a full wavelength, the 90° bend occurs near the current maximum points. In this manner, the radiation center of the dipole is closer to the mast 19. This is necessary in order to achieve good circular polarization with a pattern that closely approximates the pattern from the horizontal radiators. The vertical dipole system 23 is fed approximately a full wavelength from the fed point of dipole system 21. The turnstile radiators 24, 25, 26 and 27 are fed by separate coax feed lines. Radiator 24 is excited in the manner illustrated in FIG. 5 with the outer conductor electrically coupled to the mast 19 and the center conductor coupled to the radiator 24 at the vertical midpoint. Radiator 27 is excited in the same manner but with radiator 24 having a feed line that is 90° longer than the feed line for radiator 24. Radiator 26 is excited in the manner illustrated in FIG. 6 wherein the outer conductor is connected to the radiator 26 and terminates at the midpoint thereof and the center conductor is coupled to the mast 19. Radiator 25 is fed in identical manner with radiator 26 but the feed line has an electrical length which is 90° longer. The vertical dipoles have the same phase rotation with the reference zero phase 135° clockwise about the mast from the horizontal zero phase. As shown in FIG. 2, vertical dipole element 34 is fed with a feed line system at the balun point (end adjacent the mast) which is zero phase. An additional 90° phase to the dipole 34 is provided by the balun. The phase rotation in the vertical dipole system is achieved by the feed lengths to dipoles 33 and 35 being 90° longer and the upper dipole arms of dipoles 33 and 34 being connected to the center conductor. In order to achieve the best axial ratio, the feed line lengths between the horizontal and vertical elements were adjusted such that the line length to the vertical dipoles is electrically about 25° longer from the signal source to balun (point of 73 for example for dipole 33).

Figure 7:
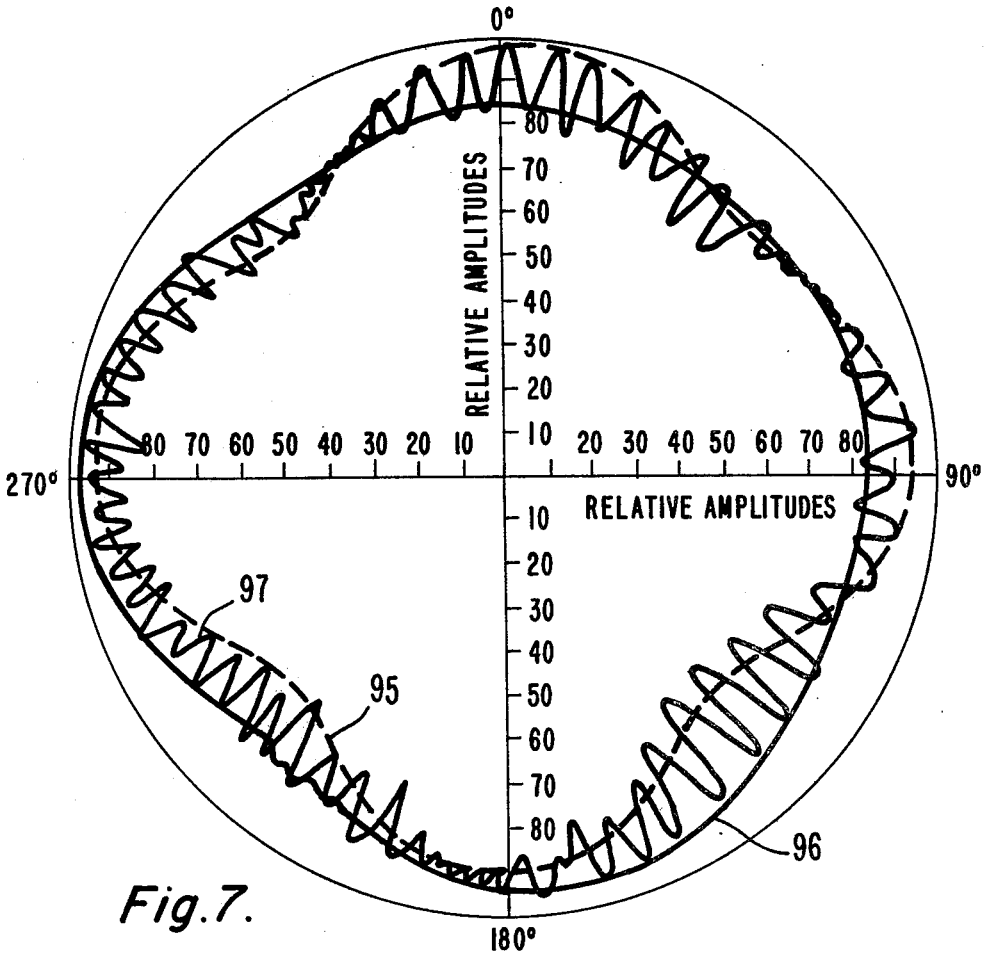
FIG. 7 illustrates the horizontal patterns associated with the system of FIG. 1.

FIG. 7 is a plot of the horizontal pattern with power and phasing adjusted as described above with the system of FIG. 1. The measured vertically polarized radiation pattern is illustrated by dashed line plot 95 and the horizontally polarized radiation pattern is illustrated by plot 96. The serrated pattern 97 illustrates the axial ratio.

In addition, the relative power ratio to the horizontal radiators and the vertical dipole system is adjusted relative to their gain. The adjustment of power is about 2dB additional power to the vertical dipoles. The horizontal pattern about the mast can be adjusted by adjusting the relative power to the radiators. If an omnidirectional pattern is desirable equal power level would be applied to the elements in the vertical or horizontal radiator system. Although only two stacked circular polarization systems are shown in FIG. 1, more gain in horizontal direction can be achieved by additional stacked systems.

What is claimed is:

1. A circularly polarized antenna system comprising:

a vertically oriented support mast, a first system of four horizontal radiating elements mounted about the mast at 90° intervals with the elements extending from the mast and configured to excite horizontally polarized fields, means for feeding signal energy to said four horizontal radiating elements in relative phase rotation of 0°, 90°, 180° and 270°, a second system of four vertically oriented dipoles mounted to the mast a given vertical distance from said first system, said vertically oriented dipoles being electrically substantially greater than a half wavelength and being configured to present the aperture of a half wavelength dipole, said vertically oriented dipoles each comprising a pair of vertically extending dipole arms with each arm having a bend near the midpoint of said arm for reducing unwanted radiation above and below said dipole, means for feeding signal energy to each of said four vertically oriented dipoles in relative phase rotation of 0°, 90°, 180° and 270°, said second system of four vertically oriented dipoles being spaced from each other and fed in amplitude and phase relationship with respect to said first system of four horizontal radiating elements to cause the horizontal pattern of the vertically polarized field associated with the vertical dipoles to be of similar shape and magnitude and in phase quadrature to the horizontal pattern of the horizontally polarized field associated with the four horizontal radiating elements.

2. The combination of claim 1 wherein said vertical extending arms are generally V-shaped in the vertical plane with the vertex of the V-shape pointing toward the mast.

3. The combination of claim 2 wherein the angle of the bend in each of the vertical dipole arms is such that the two halves of the V are generally orthogonal.

4. The combination of claim 3 wherein the angle of the bend is about 90°.

5. The combination of claim 1 wherein the plane of each of said vertical dipoles is displaced generally about 45° with respect to the plane of the horizontal dipoles.

6. A circularly polarized antenna system comprising:

a vertically oriented support mast, a plurality of circularly polarized antenna systems stacked one above the other along the mast each system comprising:

a first system of four horizontal radiating elements mounted about the mast at 90° intervals with the elements extending from the mast and configured to excite horizontally polarized fields, means for feeding signal energy to said four horizontal radiating elements in relative phase rotation of 0°, 90°, 180° and 270°, a second system of four vertically oriented dipoles mounted to the mast a given vertical distance from said first system, said vertically oriented dipoles being electrically substantially greater than half wavelength and being configured to present the aperture of a half wavelength dipole, said vertically oriented dipoles each comprising a pair of vertically extending dipole arms with each arm having a bend near the midpoint of said arm for reducing unwanted radiation above and below said dipole, means for feeding signal energy to each of said four vertically oriented dipoles in relative phase rotation of 0°, 90°, 180°, and 270°, said second system of four vertically oriented dipoles being spaced from each other and fed in amplitude and phase relationship with respect to said first system of four horizontal radiating elements to cause the horizontal pattern of the vertically polarized field associated with the vertical dipoles to be of similar shape and magnitude and in phase quadrature to the horizontal pattern of the horizontally polarized field associated with the four horizontal radiating elements.

* * * * *